United States Patent [19]

Ballet

[11] Patent Number: 4,928,366

[45] Date of Patent: May 29, 1990

[54] SIMPLIFIED AND IMPROVED SAFETY-BELT BUCKLE

[75] Inventor: Jean-Noël Ballet, Aillevilliers, France

[73] Assignee: ECIA - Equipements et Composants pour l'Industrie Automobile, Audincourt, France

[21] Appl. No.: 346,683

[22] Filed: May 3, 1989

[30] Foreign Application Priority Data

May 6, 1988 [FR] France ..... 88 06170

[51] Int. Cl.[5] ..... A44B 11/25

[52] U.S. Cl. ..... 24/641; 24/636

[58] Field of Search ..... 24/641, 642, 636, 639, 24/655

[56] References Cited

U.S. PATENT DOCUMENTS

| | | | |
|---|---|---|---|
| 3,871,090 | 3/1975 | Romanzi, Jr. et al. | 24/641 |
| 4,237,586 | 12/1980 | Morinaga | 24/641 |
| 4,575,907 | 3/1986 | Takada | 24/641 |
| 4,624,034 | 11/1986 | Ishiguro et al. | 24/636 |
| 4,797,984 | 1/1989 | Seto et al. | 24/641 |

FOREIGN PATENT DOCUMENTS

| | | | |
|---|---|---|---|
| 2349296 | 11/1980 | France . | |
| 2379995 | 11/1982 | France . | |
| 2071753 | 9/1981 | United Kingdom | 24/641 |

*Primary Examiner*—Victor N. Sakran

*Attorney, Agent, or Firm*—Sughrue, Mion, Zinn, Macpeak & Seas

[57] ABSTRACT

The buckle intended to join a belt to an anchorage point consists, among other things, of a latch (10) and of a keeper which comprises a base (20), a lock (30), an ejector guide (40), an actuating button (50), preferably a protective covering (60) and, if necessary, a closure detector (80) and an illumination device (90).

This buckle comprises operating and locking means (70) which cause the lock to cooperate with the button and with the base either to allow opening of the locked buckle when the latter is subjected to a tensile force less than a given limit or to ensure permanent locking of the locked buckle when the latter is subjected to a tensile force at least equal to a predetermined value and prevent opening thereof.

Application to safety belts for automotive vehicles.

17 Claims, 5 Drawing Sheets

FIG_3A
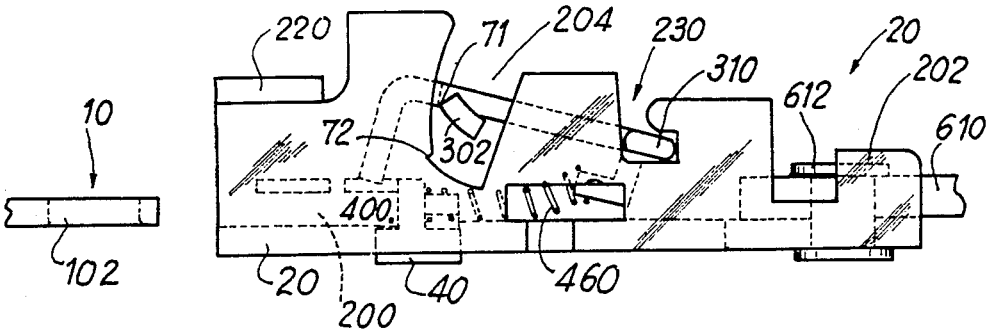
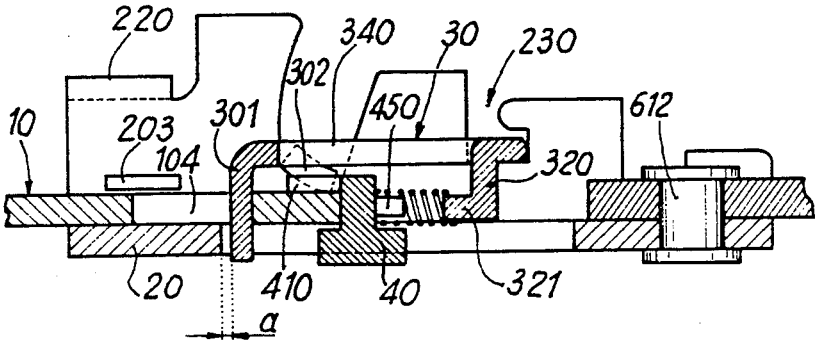
FIG_3B
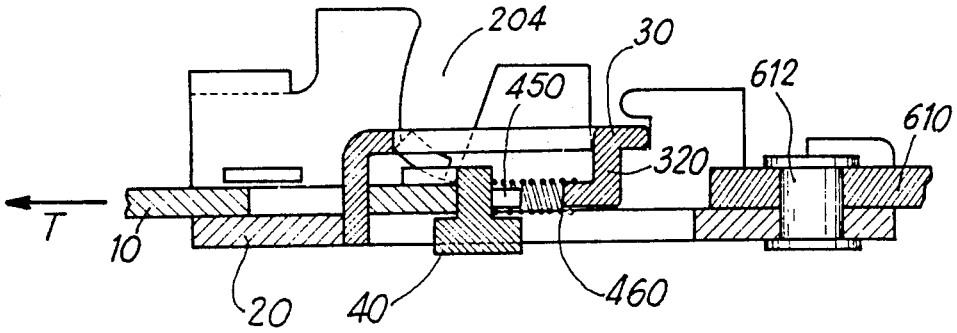
FIG_3C

SIMPLIFIED AND IMPROVED SAFETY-BELT BUCKLE

BACKGROUND OF THE INVENTION

The present invention relates to safety-belt buckles and, more particularly, those among them intended for automotive vehicles preferably of the land type.

As is known, automotive vehicles, in particular those used on land, are equipped with safety belts which must comply with rigorous specifications generally drawn up, at least in part, by the public authorities.

Under usual conditions, when a safety belt is not acting so as to keep the occupant of a vehicle on his/her seat, as it does in the case of a violent impact, the strap of the belt nomally rests against the body of the person wearing it, if necessary with a very slight tension being exerted by the return mechanism of a winding device. Under such conditions, it is relatively easy to open the buckle of a belt.

Under other circumstances, in particular when a vehicle has turned over following an accident, the strap of the safety belt is subjected to a tension which may be considerably greater; this tension is that which is, for example, exerted by the weight of an occupant who is supported by or suspended from the strap in the event of the vehicle turning over. Under such circumstances, it must be possible for the safety-belt buckle to be opened with relative ease by the occupant him/herself or by another person so that the person thus trapped may be freed. To achieve this is difficult because, in such a situation, the tension of the belt is of the order of approximately 50 daN to 60 daN and it must be possible to open the buckle by exerting a force of 25 daN which, in practice, is extremely difficult to generate.

Moreover, it is essential that, during an actual violent impact, when the safety belt keeps the occupant on his/her seat and its tension exceeds 100 daN for the brief moments when the kinetic energy is absorbed, the locked buckle does not come open at the wrong time or at the critical moment such that it becomes totally ineffective. To achieve this, buckles have been proposed, which, once locked, are kept permanently in this condition.

A safety-belt buckle wth permanent locking is, for example, described in French Patent No. 2,349,296 and its Certificate of Addition No. 2,379,995.

These documents disclose different variations of safety-belt buckles with permanent locking. All the embodiments disclosed therein satisfy the regulations, but their design is somewhat complex. Although such a design does not compromise the reliability of these buckles, it nevertheless means that relatively low manufacturing and assembly costs are difficult to achieve.

SUMMARY OF THE INVENTION

The object of the invention is to provide a safety-belt buckle, in particular for an automotive vehicle, with permanent locking which, while having the advantages of the buckle mentioned above, does not have the drawbacks thereof, in particular as regards cost.

The invention relates to a safety-belt buckle in particular for a land-type automotive vehicle, which is intended to join a strap to an anchorage point and which consists, in particular, of a latch and of a keeper which comprises, among other things, a base and, carried by the latter, a lock, an ejector guide, an actuating button and, preferably a protective covering.

This buckle is such that this base defines a channel intended to receive at least partially the latch, this lock being mounted on this base by means of an articulation which allows it to move in practice only by pivoting so as to be movable between at least two positions towards which it is elastically biased, a first releasing position where the latch is unlocked and a second retaining position where the latch is locked on the keeper by the lock, this ejector guide having a seat intended to receive the latch at least partially and being mounted on this base so as to be displaceable there in translation such that it is movable between a rest position towards which it is normally elastically biased and which it occupies when the lock is in its first position and a set position which it occupies when the lock is not in its first position, this actuating button being mounted on this base so as to be displaceable there in translation such that it is movable between an inactive position towards which it is normally elastically biased and an active position in which it causes the latch to pass into its first position.

The buckle according to the invention is characterized in that the lock is deformable elastically towards a third permanently locked position where it is directly secured to the base when it occupies its second position and in that the locked buckle is subjected to a force tending to open it which is greater than a given value and in that the operating and locking means associate this actuating button and this lock and this base such that in a first mode, when the force tending to open the locked buckle does not exceed this given value, when the actuating button passes from its inactive position to its active position, the lock moves from its second to its first position so as to release the latch and the ejector guide passes from its set position to its rest position so as to eject the latch released from the base and, in a second mode, when the force tending to open the locked buckle is equal to or exceeds this given value, the actuating button is unable to pass from is inactive position to its active position so as to dislodge the latch from its third position, cause it to pass through its second position and reach its first position.

Other characteristic features of the invention will emerge upon reading the description and claims which follow and upon examining the attached drawing provided solely by way of example, where:

BRIEF DESCRIPTION OF THE DRAWING

FIGS. 3A, 3B and 3C are partial diagrammatic views illustrating operation of the embodiment of the buckle according to the invention illustrated in FIGS. 1 and 2;

DETAILED DESCRIPTION OF PREFERRED EMBODIMENTS

Since safety-belt buckles for automotive vehicles, in particular land-type vehicles, are well-known in the art, a description will be given below only of that which directly or indirectly concerns the invention. As regards the remainder, a person skilled in the art in question will be able to draw on conventional solutions available to him in order to deal with the particular problems facing him.

The same reference number will always be used below to indicate a similar part, whatever the embodiment in question.

Figure 1:
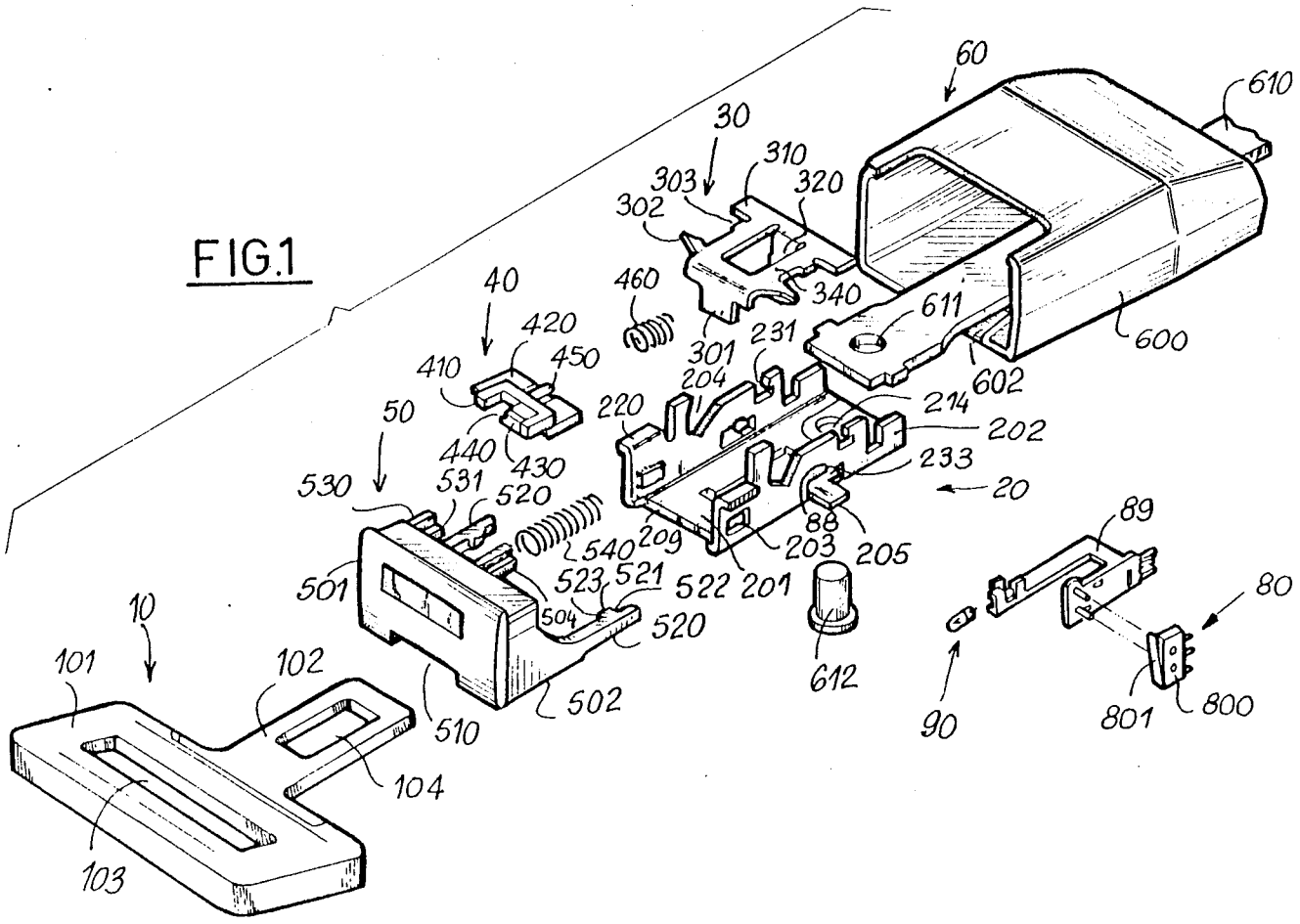
FIG. 1 is an exploded perspective view of an embodiment of a safety-belt buckle according to the invention.
Figure 5:
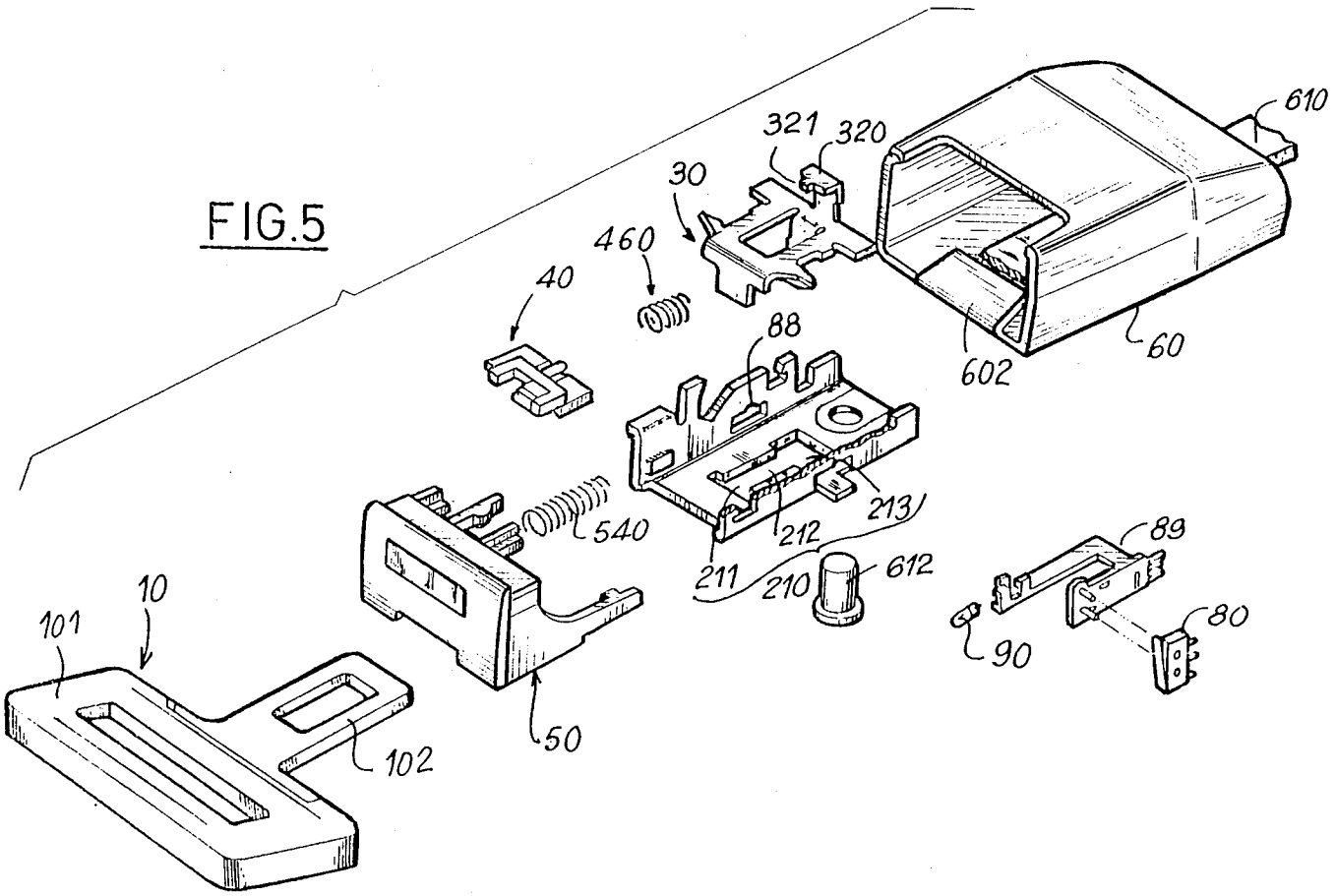
FIG. 5 is a view similar to that of FIG. 1, locally cut-away, of another variation of embodiment of a belt buckle according to the invention.

As can be seen in particular in FIGS. 1 and 5, a safety-belt buckle according to the invention, in particular for an automotive vehicle, intended to join the strap to an anchorage point, consists, among other things, of a latch 10 and a keeper comprising a base 20 and, carried by the latter, a lock 30, an ejector guide 40, an actuating button 50 and, preferably, a protective covering 60. In certain cases, this protective case also contains, if necessary, a buckle closure detector 80 and an illumination device 90.

For the sake of convenience of the description, each of the components of this safety-belt buckle according to the invention will first be described in succession.

The latch 10 comprises a body 101 provided with an extension 102. The body 101 is pierced by a passage 103 intended to receive a section of a seat belt, not shown. The seat 102 is perforated by a cut-out 104 intended to cooperate with the lock 30, as will be seen below.

The base 20 is in the form of a U-piece with a bottom 201 which joins two practically parallel flanks 202. Two internal opposite projections 203 are formed in the flanks. This bottom, these flanks and these projections define a channel 200 intended to receive the extension 102 of the latch, as will be understood below.

In the bottom 201 there is formed an opening 210 which consists of a slot 211 at one of the ends, followed by a middle window 212 and ending in an orifice 213. The function performed by each of these parts of the opening 210 will be understood below. A recess 209 is also formed in the bottom. This bottom is also pierced by a hole 214 for receiving a connection with an anchorage point, not shown.

As may be observed, each of the flanks 202 is also provided with a port 233, an aperture 204, a protuberance 205, a bearing point 231 of an articulation 230 as well as a lug 220 directed outwards, which will be referred to below.

The lock 30 is in the form of a plate on one of the faces of which there is formed a nose 301 and on the two sides of which there are also located flanges 302 and support points 303. Oriented in the same direction, the plate also has a base-piece 320 provided with a nipple 321. The sides of this plate where the flanges 302 and the support points 303 are located have trunnions 310 for the articulation 230 and form legs 340, as shown.

The ejector guide 40 comprises a shoe 410 having the shape of a two-pronged fork followed by a U-piece 420 which is extended by a heel 430 where furrows 440 are formed on two of the sides. This shoe and this U-piece define a seat 400 intended to receive the end of the extension 102 of the latch 10, as will be understood below. The ejector guide also comprises a nipple 450.

As can be seen, the actuating button 50 comprises a front face 501 and two side walls 502. The front face 501 has formed in it a mouth 510 through which the extension 102 of the latch 10 passes.

As can be seen, the side walls 502 are provided with elastic fingers 520 which each have a tooth 521. Each of the teeth 521 has a chamfer 522 and a shoulder 523. The side walls 502 also have grooves 503 intended to receive the lugs 220 of the base. The actuating button 50 also has a nipple 504 and on one of its side walls 502 a strip 530 with a rib 531 to which reference will be made later. This is all clearly illustrated in FIG. 7.

Figure 2:
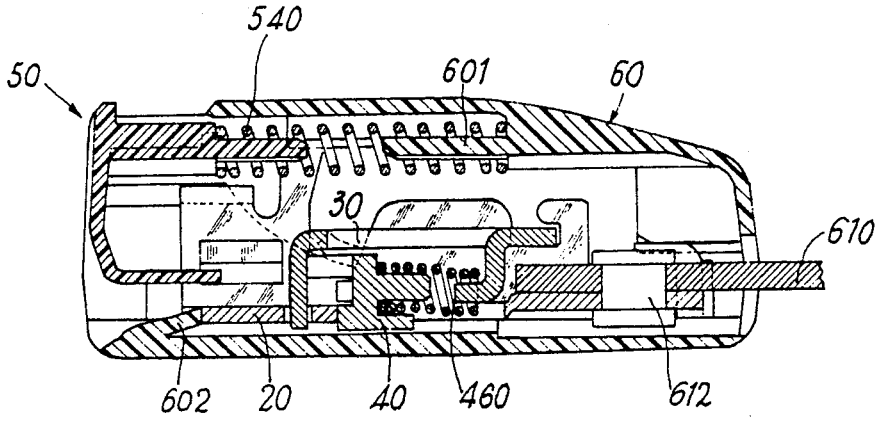
FIG. 2 is a longitudinal section through the buckle illustrated in FIG. 1, after assembly, shown in its locked position without its latch.

The protective covering 60 is in the form of a case 600 inside which there is located, if required, a nipple 601 as can be seen in FIG. 2. This covering also has a relatively rigid elastic lip 602.

As can be seen, the case 600 has passing through it a bar 610 which is able to slide there relatively freely, pierced in the vicinity of its end by a hole 611 intended to receive an eye, rivet or the like 612 in order to join this bar to the base 20 by means of the hole 214. This bar enables the keeper of the buckle according to the invention to be joined to an anchorage point, not illustrated, of the structure of a vehicle, as is conventional.

The buckle according to the invention comprises operating and locking means 70. These operating and locking means 70 consist of a cam 75 formed on each of the walls 502 of the actuating button 50, and of a counter-cam 73 located on each of the flanges 302 of the lock 30. These operating and locking means 70 also comprise an edge 71 on each of the flanges 302 of the lock 30 and a permanent-locking notch 72 provided in each of the apertures 204 formed in the flanks 202 of the base 20.

The buckle according to the invention also comprises, where necessary, a closure detector 80 housed inside the protective covering 60. This detector comprises a switch 800, the tripping member 801 of which is located in the trajectory of the lock 30 so as to be able to be actuated by one of flanges 302 of the latter.

The lock according to the invention also comprises, if necessary, an illumination device 90 housed inside the protective covering 60. This illumination device is arranged so as to illuminate at least the channel 200 of the latch 10.

The detector 80 and the illumination device 90 are mounted by any suitable conventional method, for example, on a common bracket 89 fixed on the base 20 by means of a snap-engagement assembly for example, not illustrated, intended to cooperate with an orifice 88 in the base.

A spring 460 exerts an elastic biasing force on the lock 30 and on the ejector guide 40 and a spring 540 exerts an elastic biasing force on the actuating button 50.

Figure 7:
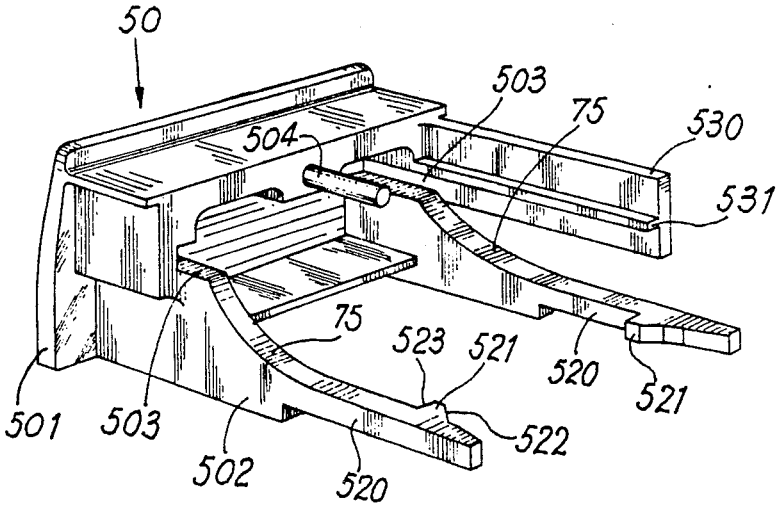
FIG. 7 is a perspective view of only the actuating button of the embodiments of FIGS. 1 and 5, showing the essential details of its configuration.
Figure 6:
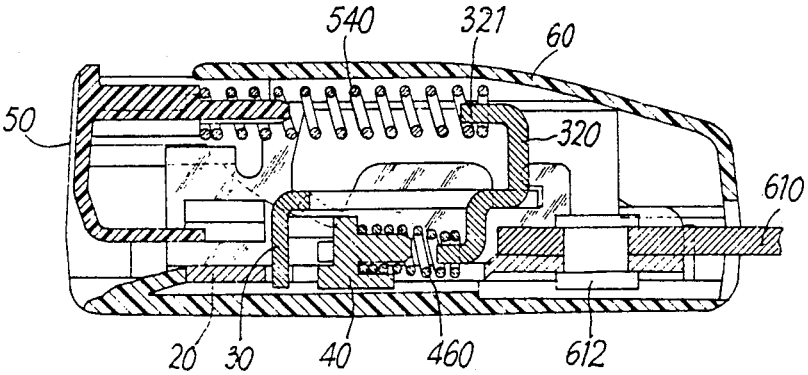
FIG. 6 is a longitudinal section through a buckle according to FIG. 5, assembled, in the locked position without a latch, similar to FIG. 2.

The components described above and illustrated clearly and precisely in particular in FIG. 1 and FIG. 7, which need merely be consulted to determine the precise individual configurations thereof, are assembled as illustrated in FIG. 2 or 6, depending on the embodiment.

As will be understood by examining FIGS. 1 and 2 in particular, the ejector guide 40 has been engaged in the opening 210 in the bottom 201 of the base 20 by first passing its heel 430 through the orifice 213 and then sliding it into the window 212 so that the furrows 440 are able to slide therein against the ridges of the latter. Then the spring 460 is threaded onto the nipple 450 and the lock 30 is suitably oriented, while engaging its trunnions 310 inside the bearing points 231 and its nose inside the slot 211, and the spring 460 is then released so that it engages onto the nipple 321 of the base-piece 320 of the lock 30. The support points 303 of the lock direct and centre the latter between the flanks 202 of the base.

Once this has been done, the actuating button 50 is engaged so that the grooves 503 cover the lugs 220 on which the said button is free to slide. To achieve this, the fingers 520 are elastically separated, the teeth 521 of which engage into the ports 233. The chamfers 522 of the teeth 521 facilitate this engagement.

The shoulders 523 serve as a stop to prevent the actuating button 50 from becoming separated from the base 20 under the thrust of the spring 540 which has been threaded onto the nipples 504 and 601 or 321. In the other direction, the travel of the actuating button is limited by cooperation of the internal side of its front face 501 and parts of the flanks 202 of the base which define apertures 204 and are oriented towards the front face.

Once this has been done, the eye or the rivet 612 is engaged into the holes 214 and 611 of the base 20 and of the bar 610, respectively, so as to join together these two components.

The spring 540 is then placed on the nipple 504 and the case 600 of the protective covering 60 is brought into position, the said case being fixed by any suitable method in the position in which it is shown in FIG. 2, in this case by snap-engaging its retaining lip 602 into the recess 209.

As a result of the configuration given to the articulation 230, the trunnions 310 of the lock 30 are able to rotate in the bearing points 231 of the base 20, without in practice sliding therein. These bearing points 231, as illustrated, have an inverted-L shaped configuration so as to facilitate mounting, and emprison the trunnions 310. As a result of the play, manual or automatic mounting and assembly are possible and correct operation is ensured. It can be seen then that the lock 30 is mounted on the base 20 in such a way that it is displaceable solely by pivoting so as to be movable between at least two positions towards which it is elastically biased by the spring 460. The lock 30 is therefore able to move between a first releasing position where the latch 10 is unlocked and a second retaining position where the latch 10 is locked onto the keeper by the lock 30. As will be understood below, this unimpeded pivoting of the lock on the base also results from the individual configurations given to the nose 301 of the lock 30 and to the slot 211 of the opening 210 in the bottom 201 of the base 20 as well as their relative positions. In its second retaining position where the lock 30 locks the latch 10 on the keeper, the latch is pushed back by the ejector guide 40 against the lock so that the nose 301 of the latter and the edge of the cutout 104 touch without the nose 301 touching the slot 211 of the base 20, a well-defined predetermined play a existing between the latter.

As seen, the ejector guide 40 is accommodated in an opening 210 in the bottom 201 of the base 20 such that its furrows 440 rest with play against the ridges of the window 212 where it is able to slide. It can be seen therefore that the ejector guide is displaceable in translation so as to be movable between a rest position towards which it is normally elastically biased by the spring 460 and which it occupies when the lock 30 is in its first position and a set position which it occupies when the lock 30 is not in its first position.

The actuating button 50, as a result of cooperation of its grooves 503 with the lugs 220 of the base 20, is displaceable there in translation so as to be movable between an inactive position towards which it is normally elastically biased by the spring 540 and a position in which it causes the lock 30 to pass into its first position.

Reference will now be made to FIGS. 3 and 4 where the embodiment described above is shown during different stages of its operation.

The various FIGS. 3 are diagrammatic and only some of the components of a buckle according to the invention are shown therein.

In FIG. 3A, the components are shown in the relative positions which they occupy either in order to fasten the latch on the keeper so as to close the buckle or immediately following opening of the buckle. In the position shown without the actuating button 50, the lock 30 is shown in its first position and the ejector guide 40 in its rest position. If the latch is now guided towards the keeper, engaging its extension 102 into the mouth of the button so that it penetrates into the channel 200 of the base 20 and then into the seat 400 of the ejector guide 40, and pushed in fully, the ejector guide 40 is gradually forced back towards its set position against the biasing force of the spring 460 which is, itself, gradually compressed. By compressing, the spring 460 produces an increasing torque on the lock 30 which, initially biased in the clockwise direction (FIG. 3A) by this spring under slight tension, pivots freely in the anti-clockwise direction about its articulation 230 as soon as it has crossed over an equilibrium point. The buckle therefore assumes its locked position shown in FIG. 3B. In this situation the lock 30 occupies its second position and the ejector guide 40 occupies its set position.

As will be easily understood, at the moment when the lock 30 pivots about its articulation 230, its nose 301 engages into the cut-out 104 in the extension 102 of the latch 10 and into the slot 211 of the opening 210 formed in the bottom 201 of the base 20. The calibration of the spring 460 is chosen so that when the lock 30 pivots from its first to its second position, the nose is located in line with the cut-out of the latch without the risk of coming into contact with the edges of the latter, which could hinder its travel. It is only when the latch is released that the ejector guide 40 is able to cause the latch to retract so that it bears against the nose of the lock, as illustrated in FIG. 3B. As may be seen in this FIG. 3B, a given and predetermined play a exists between the nose and the slot in which it is engaged.

If the locked buckle, the components of which are located in the relative positions shown in FIG. 3B, is now subjected to a tensile force T which exceeds a given value and which tends to open it, the latch being pulled with force from the keeper, the latch 10 causes the lock 30 to move towards a third permanently locked position, as shown in FIG. 3C.

As can be seen therefore, the lock is now directly secured on the base; the play a is taken up. Double cooperation occurs: on the one hand, the nose 301 is applied against the slot 210 and on the other hand the edges 71 of the flanges 302 engage into the notches 72 of the apertures 204 formed in the flanks 202 of the base 20. The position is therefore that shown in FIG. 3C.

If the tensile force T exerted on the latch and transmitted to the lock generated a component which tended to cause the lock to pass from its third position in which it is shown in FIG. 3C to its first position shown in FIG. 3A, it would be prevented from doing so by engagement of the edges 71 in the notches 72, which ensures permanent locking of the lock when in the locked position. This ensures that the closed and locked buckle cannot be opened by accident at the wrong time, precisely when it is required to perform its function, namely keep the occupant on his/her seat at all costs.

The lock is designed so that its nose 301 and its legs 340 elastically change shape so as to neutralize the predetermined initial play a when such a tensile force exceeds a chosen predetermined value, passing from its second to its third position.

Figure 4A:
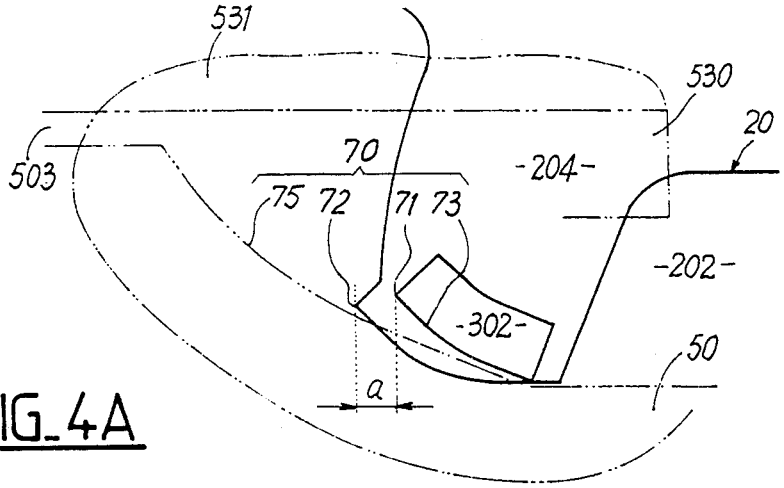
FIGS. 4A and 4B are other fragmentary views illustrating operation of this embodiment.
Figure 4B:
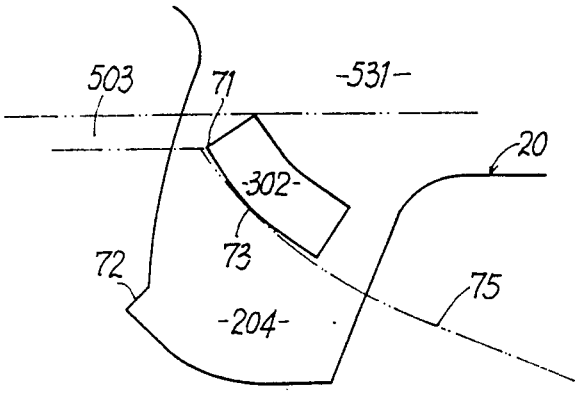

Reference will now be made to FIGS. 4A and 4B where this embodiment of the buckle according to the invention is shown diagrammatically in different positions which correspond to the phase where the buckle is opened.

In order to open the closed and locked buckle and cause it to pass from the condition in which it is shown in FIG. 3B to that in which it shown in FIG. 3A, the actuating button 50 is pressed against the biasing force of the spring 540. By doing so, the actuating button leaves its inactive position, towards which it is normally biased by the spring 540, and is guided towards an active position in which it causes the lock 30 to pass into its first position.

As can be understood and seen, by retracting from its inactive position to its active position, the grooves 503 slide against the lugs 220, and the cams 75 of the actuating button 50 come up against the counter-cams 73 of the flanges 302 of the lock 30 which they raise. The lock pivots about its articulation 230 against the torque created by the spring 460. By tilting, the nose 301 disengages from the cut-out 104 of the latch which is released and pushed back by the ejector guide 40 out of the keeper. Pivoting of the lock is limited by one of the flanges 302 coming up against the rib 531 of the strip 530 of the actuating button 50.

In the position in which the buckle is shown in FIG. 3B, there are only two contact points between the lock 30 and the base 20; these points are those which are located in the region of the articulation 230. This situation is the one which prevails when the tensile force which is exerted on the buckle does not exceed a value which is of the order of approximately 50 to 60 daN. This is the case when an occupant is suspended from the strap of the belt in a vehicle turned on its side or overturned on its roof; it is the weight of this occupant which exerts a tensile force on the buckle.

In the situation shown in FIG. 3C which corresponds for example to that where the tensile force exerted on the buckle is greater than 100 daN during the brief instants of a relatively violent sudden collison, it can be seen that the number of contact points between the lock and the base has been increased considerably. In fact, in addition to those resulting from the articulation 230, mentioned previously, there are also the two contact points of the edges and the notches as well as that of the nose with the slot of the opening in the bottom.

Reference will now be made to FIGS. 5 and 6. It can be seen immediately that the essential difference lies in the fact the spring 540 which elastically biases the actuating button 50 no longer acts directly on the case 600 of the protective covering 60, but on a nipple 331 of a projecting part 330 formed on the lock 30 and, more particularly, on the face of the plate of the latter which is opposite to that on which the nose 301, the flanges 302 and the base-piece 320 are directed. As regards the remainder, operation is exactly the same.

The buckle closure detector 80 is mounted as can be seen in the Figures of the drawing. This detector comprises for example a microswitch 800, the tripping member 801 of which is located on the trajectory of one of the flanges 302 of the lock. This switch is such that when the lock occupies its first releasing position where the latch is unlocked, the switch is operated so as to activate a signalling circuit (not illustrated). On the other hand, when the lock does not occupy its first position, its flange 302 no longer acts on the tripping member of the switch and the latter is in the rest condition. This signalling circuit may be of any known type for triggering an acoustic and/or luminous signal in the vehicle indicating that the occupant of a vehicle has not put on and attached his/her safety belt. This switch may be of the type consisting of a normally open or normally closed contact.

The illumination device 90 which comprises a miniature-filament lamp or an electroluminescent diode, for example, is oriented so as to illuminate, preferably, the channel 200 and the mouth 510 so as to facilitate insertion of the latch into the keeper. Switching on and off of this illumination device is effected, for example, simultaneously with switching on and off of the ceiling light of the motor vehicle when the doors are opened or closed or when the parking lights and/or headlamps are switched on. The conventional electrical circuit is not illustrated.

The ejector guide 40, the actuating button 50 and the protective covering 60 are, for example, made of synthetic material and are obtained for example by means of moulding. The actuating button 50 is, preferably, translucent so that the light emitted by the illumination device can be seen.

The case 600 of the protective covering 60 may be moulded as a single piece or consists of two half-shells assembled in any suitable known manner.

The latch 10, the base 20 and the lock 30 are, preferably, made of metal and obtained by means of stamping, cutting and folding of metal sheets, as is known. If the embodiments of FIGS. 1 and 5 are compared, it can be seen that the lock 30 of FIG. 1 is easier to manufacture than that shown in FIG. 5. In this respect, particular care must be taken in choosing the type of material from which the lock 30 is made, so that it has the elasticity necessary for the invention. The amount of play a, the dimensions and the cross-sections of the noses and legs are closely dependent upon the mechanical properties of this material and the choice of the latter is also dependent upon the manufacturing methods used, which themselves are linked wth the equipment and tools available.

It is possible to see all the advantages of the safety-belt buckle according to the invention which, with a minimum of components which are relatively easy to manufacture using conventional methods, nevertheless has a greater operational reliability owing to the existence of a permanently locked condition of the lock when in the locked position, which is obtained without the addition of any extra parts.

What is claimed is:

1. Safety-belt buckle in particular for a land-type automotive vehicle, which is intended to join a strap to an anchorage point and which consists, in particular, of a latch (10) and of a keeper comprising, among other things, a base (20) and, carried by the latter, a lock (30), an ejector guide (40), an actuating button (50) and, if necessary, a protective covering (60), in which this base

(20) defines a channel (200) intended to receive at least partially the latch (10), this lock (30) being mounted on this base (20) by means of an articulation (230) which allows it to move in practice only by pivoting so as to be movable between at least two positions towards which it is elastically biased, a first releasing position where the latch (10) is unlocked and the lock (30) is away from the ejector guide (40) and a second retaining position where the latch (10) is locked on the keeper by the lock (30), this ejector guide (40) having a seat (400) intended to receive the latch (10) at least partially and being mounted on this base (20) so as to be displaceable there in translation such that it is movable between a rest position towards which it is normally elastically biased and which it occupies when the lock (30) is in its first position and a set position which it occupies when the lock (30) is not in its first position, this actuating button (50) being mounted on this base (20) so as to be displaceable there in translation such that it is movable between an inactive position towards which it is normally elastically biased and an active position in which it causes the latch (30) to pass into its first position, characterized in that this lock (30) is deformable elastically towards a third permanently locked position where it is directly and positively locked to the base (20) only through a direct engagement of a lock edge (71) with a permanent-locking notch (72) of the base (20) when it occupies its second position and wherein the locked buckle is subjected to a force tending to open it which is greater than a given value and in that operating and locking means (70) associate this actuating button (50) and this lock (30) and this base (20) such that in a first mode, when a force tending to open the locked buckle does not exceed this given value, when the actuating button (50) passes from its inactive position to its active position, the lock (30) moves from its second to its first position so as to release the latch (10) and the ejector guide (40) passes from its set position to its rest position so as to eject the latch (10) released from the base (20) and, in a second mode, when a force tending to open the locked buckle is equal to or exceeds this given value, the actuating button (50) is unable to pass from its inactive position to its active position so as to dislodge the latch (30) from its third position, cause it to pass through its second position and reach its first position.

2. Buckle according to claim 1, characterized in that the operating and locking means (70) comprise at least one cam (75) located on the actuating button (50) and cooperating with at least one counter-cam (73) of the lock (30) so as to cause it to move towards its first position.

3. Safety-belt buckle in particular for a land-type automotive vehicle, which is intended to join a strap to an anchorage point and which consists, in particular, of a latch (10) and of a keeper comprising, among other things, a base (20) and, carried by the latter, a lock (30), an ejector guide (40), an actuating button (50) and, if necessary, a protective covering (60), in which this base (20) defines a channel (200) intended to receive at least partially the latch (10), this lock (30) being mounted on this base (20) by means of an articulation (230) which allows it to move in practice only by pivoting so as to be movable between at least two positions towards which it is elastically biased, a first releasing position where the latch (10) is unlocked and a second retaining position where the latch (10) is locked on the keeper by the lock (30), this ejector guide (40) having a seat (400) intended to receive the latch (10) at least partially and being mounted on this base (20) so as to be displaceable there in translation such that it is movable between a rest position towards which it is normally elastically biased and which it occupies when the lock (30) is in its first position and a set position which it occupies when the lock (30) is not in its first position, this actuating button (50) being mounted on this base (20) so as to be displaceable there in translation such that it is movable between an inactive position towards which it is normally elastically biased and an active position in which it causes the latch (30) to pass into its first position, characterized in that this lock (30) is deformable elastically towards a third permanently locked position where it is directly secured to the base (20) when it occupies its second position and in that the locked buckle is subjected to a force tending to open it which is greater than a given value and in that operating and locking means (70) associate this actuating button (50) and this lock (30) and this base (20) such that in a first mode, when a force tending to open the locked buckle does not exceed this given value, when the actuating button (50) passes from its inactive position to its active position, the lock (30) moves from its second to its first position so as to release the latch (10) and the ejector guide (40) passes from its set position to its rest position so as to eject the latch (10) released from the base (20) and, in a second mode, when a force tending to open the locked buckle is equal to or exceeds this given value, the actuating button (50) is unable to pass from its inactive position to its active position so as to dislodge the latch (30) from its third position, cause it to pass through its second position and reach its first position; and in that the operating and locking means (70) comprise at least one cam (75) located on the actuating button (50) and cooperating with at least one counter-cam (73) of the lock (30) so as to cause it to move towards its first position and at least one permanent-locking notch (72) formed on the base (20) and cooperating with an edge (71) of the lock (30) so as to determine the third position of the latter.

4. Buckle according to claim 2 or 3, characterized in that the lock (30) has the configuration of a plate on two of the sides of which there are formed flanges (302) where these edges (71) and counter-cams (73) are located.

5. Buckle according to claim 3, characterized in that the elastic biasing of the actuating button (50) towards its inactive position is performed by a spring (540) which rests on the lock (30).

6. Buckle according to claim 4, characterized in that the lock (30) comprises, oriented on the opposite side of this face of the plate, a projecting part (320) on which the spring (540) rests.

7. Buckle according to claim 3, characterized in that the lock (30) comprises, oriented towards the same face of the plate as the flanges (302), a nose (301) intended to cooperate with the latch (10) so as to lock it and a base-piece (320) intended to receive the elastic biasing force.

8. Buckle according to claim 6, characterized in that the plate has two legs (340) and in that the elastic deformation of the lock occurs in the region of these legs (340) and said nose (301).

9. Buckle according to claim 6, characterized in that the elastic biasing of the lock (30) and that of the ejector guide (40) are performed by a single spring (460).

10. Buckle according to claim 1 or 3, characterized in that the elastic biasing of the actuating button (50) towards its inactive position is perfomed by a spring (540) which rests on the protective covering (60).

11. Buckle according to claim 1 or 3, characterized in that the articulation (230) comprises trunnions (310) located on the lock (30) and L-shaped bearing points (231) formed in the base (20).

12. Buckle according to claim 10 characterized in that the detector (80) and the illumination device (90) are mounted on a common bracket (89) fixed on the base (20).

13. Buckle according to claim 10, characterized in that the detector (80) comprises a switch (800), the tripping member (801) of which is actuated by the lock (30).

14. Buckle according to claim 13 characterized in that the tripping member (801) is located on the trajectory of one of the flanges (302) of the lock (30) when the latter is displaced from one of its positions to the other.

15. Buckle according to claim 1 or 3 characterized in that it comprises an illumination device (90) housed in the protective covering (60).

16. Buckle according to claim 15 characterized in that the illumination device (90) is arranged so as to illuminate at least a channel (200) of the latch (10).

17. Buckle according to claim 1 or 3 characterized in that it comprises a buckle closure detector (80), housed in the protective covering (60).

* * * * *